US006244784B1

(12) United States Patent
Gordon

(10) Patent No.: US 6,244,784 B1
(45) Date of Patent: Jun. 12, 2001

(54) BUOYANCY COMPENSATOR AND METHOD OF CONSTRUCTING THE SAME

(75) Inventor: John Yeats Gordon, Timothy Cottage (GB)

(73) Assignee: American Underwater Products Inc., San Leandro, CA (US)

( * ) Notice: Subject to any disclaimer, the term of this patent is extended or adjusted under 35 U.S.C. 154(b) by 0 days.

(21) Appl. No.: 09/164,077

(22) Filed: Sep. 30, 1998

(51) Int. Cl.[7] ..... B63C 9/125; B63C 11/02

(52) U.S. Cl. ..... 405/186; 441/108; 441/113; 441/114

(58) Field of Search ..... 405/186, 193; 441/80, 88, 96, 106, 108, 111–114

(56) References Cited

U.S. PATENT DOCUMENTS 2,046,335 * 7/1936 Manson ..... 441/96
4,778,425 * 10/1988 Hattori ..... 441/88
4,810,134 * 3/1989 Eaucolner et al. ..... 405/186
4,952,095 * 8/1990 Walters ..... 405/186
5,022,879 * 6/1991 DiForte ..... 441/108 X
5,385,496 * 1/1995 Seligman ..... 405/186 X
5,522,679 * 6/1996 Eungard ..... 405/186
5,607,258 * 3/1997 Eungard ..... 405/186

* cited by examiner

*Primary Examiner*—Eileen D. Lillis
*Assistant Examiner*—Tara L. Mayo
(74) *Attorney, Agent, or Firm*—Bruce & McCoy; Ernest H. McCoy

(57) ABSTRACT

A method and construction for a buoyancy compensator air chamber bellows utilizing a single side coated fabric having air passages for gas communication between the air chambers formed by annular disks which are welded together around and through the air passages to interlock the air chambers into a bellows.

3 Claims, 2 Drawing Sheets

BUOYANCY COMPENSATOR AND METHOD OF CONSTRUCTING THE SAME

BACKGROUND OF THE INVENTION

1. Field of the Invention

The present invention relates to buoyancy compensators for scuba divers. More particularly, it relates to a method and apparatus for the construction of a multiple air chamber buoyancy compensator which can be welded together utilizing a single side impregnated fabric.

2. Description of the Prior Art

Buoyancy compensators (BCs) of various designs and construction have been used by scuba divers for many years. The bladder of the BC can be partially filled with air to provide neutral buoyancy to compensate for the weight that the diver is carrying. The bladder can also be inflated by air carried in the diver's tank to raise the diver to the surface in an emergency.

The air chambers in the bladder of modern BCs generally have a bellows construction for compactness when collapsed and have been assembled by gluing layers of fabric together. However, over time the glue deteriorates and the seams come apart. With the development of rubber and particularly urethane coated fabrics, the fabric layers could be radio frequency (RF) or heat welded together at the seams.

The closest known prior art related to the present invention is U.S. Pat. No. 5,385,496, issued Jan. 31, 1995, to Seligman for a Buoyancy Compensator with Lateral Expansion and Method Therefor. It discloses an air chamber construction in FIGS. 1 and 2 thereof which utilizes a single side impregnated fabric, but the design architecture limits the construction to a single air chamber. FIGS. 11–13 thereof disclose multiple chamber designs of fabric construction but the welding architecture requires double side impregnated fabric. It is the multiple chamber design of FIGS. 11–13 which the present invention can accomplish the single side impregnated fabric at great cost savings and longer product life.

The problems with the prior art form of construction for making a bellows type BC include the expense involved in utilizing a fabric which is impregnated on both sides. The fabric is substantially more expensive than a single side impregnated fabric and the fabrics are very expensive and constitute a substantial part of the cost of manufacture. In addition, and equally important, is the fact that an external side impregnated fabric abrades severely in use and in the underwater environment and, when exposed to sunlight, deteriorates and delaminates over time.

SUMMARY OF THE INVENTION

The present invention is a buoyancy compensator (BC) construction for a multiple air chamber bellows type bladder utilizing a single layer of coated fabric for its air chambers. The invention comprises at least a pair of contiguous air chamber with a multiplicity of internal gas communication passages therebetween. The BC construction is characterized by the air chambers being formed of a fabric having only the internal air chamber side thereof impregnated with a coating which is susceptible to welding to another surface of the coating. The air chambers have adjacent walls interlocked around the gas communication passages at a sufficient number of locations whereby the air chambers are tied together to form a bellows-type expandable bladder. The air chamber outer walls are welded to the expandable bladder at the peripheral edges thereof whereby all of the coated sides of the fabric comprising the BC are disposed internal to the air chambers. Only the fabric sides are disposed outward and exposed to the external environment. At least one valve means is provided for facilitating the introduction, containment, and release of gas with respect to the air chambers.

The present invention also comprises a method of construction for a BC which permits utilization of single side coated fabric for a multiple chamber inflatable buoyancy compensator (BC) which obviates the necessity of exposing any of the coated fabric surfaces to the surrounding environment. The steps of the method comprise utilizing throughout the construction of the air-containing portions of the BC a fabric having only one side thereof impregnated with a coating which is susceptible to welding to another surface of the coating. The method employs in the design architecture of the BC at least two or more contiguous air chambers with a multiplicity of internal gas communication passages formed integral thereto to permit gas to pass therethrough between said chambers. It disposes for exposure to the environment only the uncoated surfaces and edges of the fabric whereby the contiguous surfaces of the air chambers are arranged with the fabric side of the coated fabric opposed to the adjacent fabric side of the adjacent chamber and the internal surfaces of the air chambers are comprised of the coated surfaces of the fabric. The method includes welding the contiguous chambers of the BC together at the gas communication passages with aligned annular disks comprised of the one side coated fabric. The disks are disposed in each of the chambers to surround and overlap the air communication passage holes formed in the contiguous fabric layers which are aligned in the air chambers. The disks are arranged in coated surface opposed facing relation in the respective chambers whereby when the disks are welded together, the center portions of the disks are joined together through the air chamber passages forming an air passage in the centers thereof. The peripheral edges of the disk are joined to the internal surfaces of the contiguous air chambers respectively thereby interlocking the air chambers at the centers of the disks. Finally, the peripheral edges of the internal surfaces of the chambers are welded together to form an air containing BC.

OBJECTS OF THE INVENTION

It is therefore an important object of the present invention to provide a multiple chamber bellows construction for a BC bladder which utilizes a single side impregnated fabric.

It is another object of the present invention to provide a new and novel method for the construction of a BC bellows bladder.

It is a further object of the present invention to provide a design architecture which provides air communication passages in a multiple chamber BC bellows bladder which are provided with a reinforced seal that fastens the multiple chambers together.

And it is still another object of the present invention to provide a method of assembly of a BC bellows bladder which permits RF welding of multiple seams and seal simultaneously.

Other objects and advantages of the present invention will become apparent when the method and design of the present invention are considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
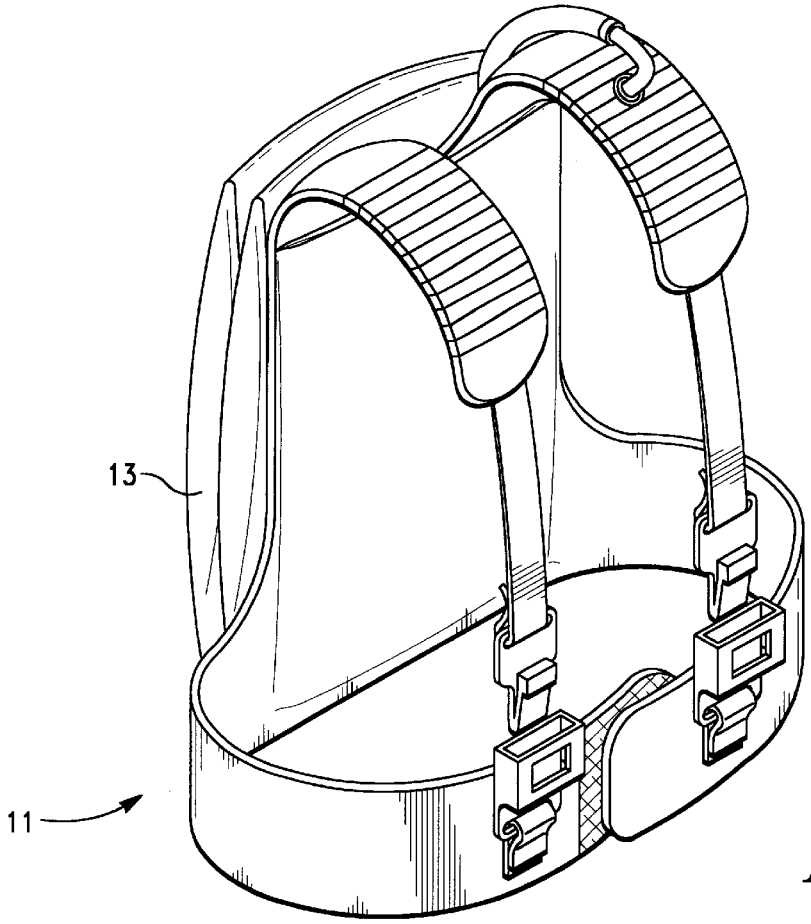
FIG. 1 is a perspective view of a buoyancy compensator utilizing the construction and method for the BC bellows bladder of the present invention.

FIG. 1 is a perspective view of a buoyancy compensator (BC) 11 utilizing the air chambers bellows construction of the present invention. The design architecture of the BC permits utilization of a single side coated fabric for a multiple chamber inflatable bladder 13. The design obviates the necessity of exposing any of the coated fabric surfaces to the surrounding environment to prevent abrasion thereof and to inhibit deterioration and delamination. One of the best coatings for a fabric which provides an air tight fabric and high strength RF seam weld is a soft rubber such as urethane. However, these coatings are universally susceptible to abrasion which can be severe when employed externally in BC construction. The coatings are also susceptible to breakdown and delamination when exposed to the atmosphere and extensive sunlight. The design of the present invention prevents both of these conditions from occurring because all of the coated surfaces are disposed internal of the BC bladder.

Figure 3:
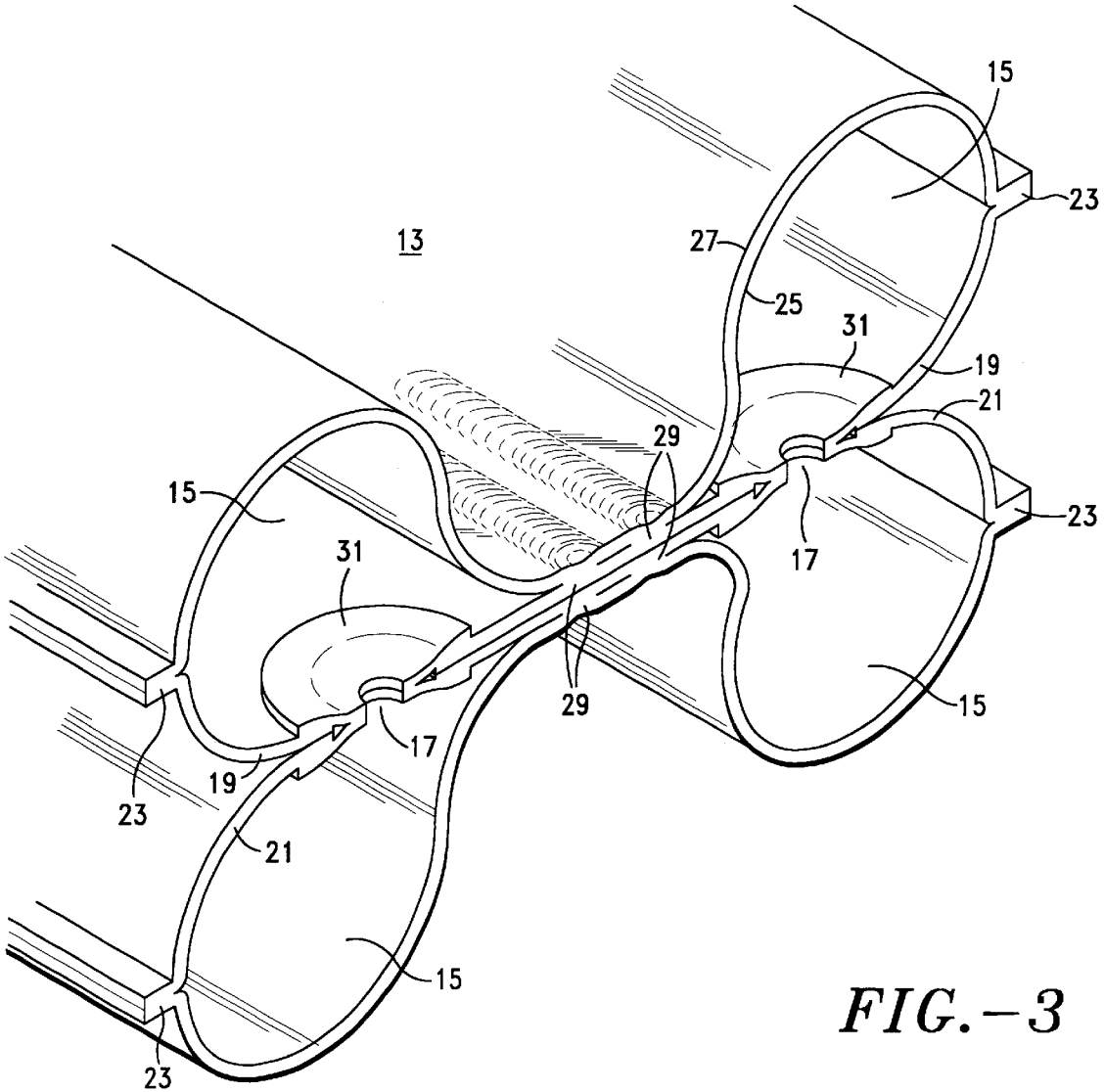
FIG. 3 is a perspective view in cross-section of a double chamber BC bellows bladder constructed in accordance with the design architecture and method of assembly of the present invention.

Reference is made to FIG. 3. The buoyancy compensator 11 construction of the present invention utilizes a single layer, of one side coated, external surface fabric for all of its air chambers 15. It is comprised of at least a pair of contiguous air chambers with a multiplicity of internal gas communication passages 17 between the chambers. An infinite number of chambers could be constructed utilizing this design, and all would have the coated surface of the fabric disposed internal to the bellows or bladder 13. The BC construction is characterized by the air chambers being formed with the fabric having only the internal air chamber side thereof impregnated with a coating which is susceptible to welding to another surface of the same coating.

The air chambers 15 of the bladder 13 have adjacent walls 19, 21 interlocked around the gas communication passages 17 at a sufficient number of locations whereby the air chambers are tied together to form a bellows type expandable bladder. The air chamber walls are welded at the peripheral edges 23 thereof to the expandable bladder in which all of the coated sides 25 of the fabric comprising the BC are disposed internal to air chambers and only the fabric side 27 of the material and the edges are disposed outward and exposed to the external environment.

In the practical design of the bellows 13, it can be made in an oval shape whereby the air passages 17 communicating between the chambers 15 can be aligned in pairs. The electrodes for RF welding the layers together at the air passages can be all positioned at the same level with locating pins in the center whereby all of the internal welds, sealing the air passages, can be effected simultaneously. The peripheral edges 23 can then be sealed with a single encircling weld as well as central linear welds 29 which can be done simultaneously. (In FIGS. 2 and 3 of the drawings, where a weld between the opposed coatings has occurred, the weld is represented by a continuous zone without material separation lines. Cross-batching has been omitted in FIG. 3 to more clearly illustrate the weld area.)

At least one valve means is provided for facilitating the introduction, containment, and release of gas with respect to the air chambers. Generally, an air tube is provided for filling the chambers by lung exhale pressure, and a separate inlet is connected to reduced air tank pressure with a control valve. A combination quick release air pressure and overpressure dump valve is usually also provided for releasing air from the bladder.

Figure 2:
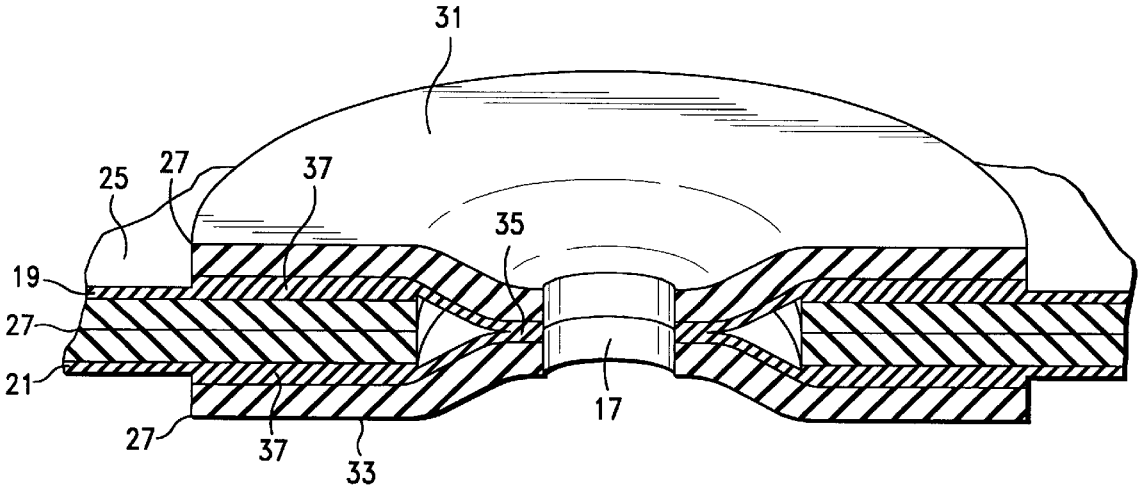
FIG. 2 is a broken out section showing the construction of a fabric weld surrounding a gas communication passage in the interior of a BC bellows bladder.

Reference is made to FIG. 2 which shows in cross-section the construction detail of an air passage 17 as shown in FIG. 3. The buoyancy compensator bellows air chamber construction is facilitated by the unique characteristic wherein the air chamber walls are interlocked together around the air communication passages by a construction which includes for each interlock a pair of annular disks 31, 33 made of the same single side coated fabric forming the BC bellows or bladder 13. The disks are disposed one each in each of the chambers for each of the passages with the coated surfaces thereof in opposed welded relation on opposite sides of and surrounding the gas communication passages. The passages in the air chamber fabric are large enough in size to permit the center portions of the annular disks surrounding the center holes therein to be welded together through the center portions thereof 35. The outer peripheral portions of the aligned and opposed disks surrounding the gas passages are welded 37 to the respective internal surfaces of the adjacent two contiguous fabrics 19, 21 which form the gas passages thereby interlocking the two fabric panels in contiguous opposed relation.

While the annular disks 31, 33 are a preferred embodiment for creating the seals around the air communication passages 17, any configuration of material with an aperture in the middle can serve the purpose of sealing the layers of material together forming a gas communication passage therethrough. The invention is for that reason not to be limited to annular disks. Likewise, the materials can be welded together by heat as well as RF or by gluing using a solvent, and those forms of welding of the material are the equivalent of an RF weld although usually more expensive to effect.

The present invention also includes the method of construction which permits utilization of a single side coated fabric for inflatable buoyancy compensator construction which obviates the necessity of exposing any coated fabric surfaces to the surrounding environment. The steps comprise utilizing throughout the construction of the air containing portions of the buoyancy compensator a fabric having only one side thereof impregnated with a coating which is susceptible to welding to another surface of the same coating.

The method employs in the design architecture of the buoyancy compensator at least two or more contiguous air chambers with a multiplicity of internal gas communication passages formed integral thereto to permit gas to pass therethrough between the chambers.

The method includes disposing for exposure to the environment only the uncoated surfaces and edges of the fabric whereby the contiguous surfaces of the air chambers are arranged with the fabric side of the coated fabric opposed to the adjacent fabric side to the adjacent chamber and the internal surfaces of the air chambers are comprised only of the coated surfaces of the fabric.

The contiguous chambers of the BC are welded together at the gas communication passages with aligned annular disks comprised of one side coated fabric. The disks are disposed in each of the chambers to surround and overlap the air communication passage holes formed in the contiguous fabric layers which are aligned in the air chambers. The disks are arranged in coated surface opposed facing relation in the respective chambers whereby when the disks are welded together, the center portions of the disks are joined together through the air chamber passages forming an air passage in the centers thereof. The peripheral edges of the disk are joined to the internal surfaces of the contiguous air chambers respectively thereby interlocking air chambers at the centers of the disks.

The peripheral edges and one or more centerlines of the internal surfaces of the chambers are welded together to form an air containing BC bellows having an oval shaped annular configuration.

The method of the present invention of buoyancy compensator construction also employs the method described above including the further steps wherein the contiguous air chambers are formed by cutting contiguous panels of material of the single sided fabric with aligned apertures or holes for gas communication passages. A set of upward facing electrodes are provided for welding the panels together at the apertures. The electrodes include a pin which extends through the holes in the panels for alignment of the panels thereon. The method includes placing successively on each electrode a first disk of the fabric with their coated sides facing up. Next, a first panel of the fabric is placed with all of its holes aligned on the set of electrodes with its coated side facing down. A second panel of the fabric is then placed on the set of electrodes with its coated side facing up and aligned concentrically with the first panel. Finally, a second disk of the fabric is placed on each of the electrodes with their coated sides facing down and aligned concentrically with the first and second panels and the first disk. As a result, the gas communication passages are created through all four layers of the materials with the central portions of the disks in opposing coated surface contiguous relation and the outer coated portions of the disks disposed in contiguous relation to the coated surface of the first and second panels whereby the two center panels are disposed fabric to fabric surrounding the gas passages. A mirror image set of electrodes is placed down onto the upward facing electrode on top of the second disk. The outer portions of the disks are welded to the contiguous portions of the first and second panels of material respectively and the center portions of the disks are welded together at the centers thereof. A pair of external panels having the same peripheral configuration as the contiguous panels of material are cut and welded at the peripheral edges thereof to the opposite sides of the contiguous panels respectively forming a multichamber, single side impregnated, fabric air bladder.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

What is claimed is:

1. A method for construction of an inflatable buoyancy compensator (BC) which permits utilization of single side coated fabric for its construction which obviates the necessity of exposing any of the coated fabric surfaces to the surrounding environment, the steps comprising providing a single sided coated fabric having only one side thereof impregnated with a coating which is susceptible to welding to another surface of said coating and utilizing the same throughout the construction of the air-containing portions of said buoyancy compensator, employing in the design architecture of said BC at least two or more contiguous air chambers with a multiplicity of internal gas communication passages formed integral thereto to permit gas to pass therethrough between said chambers, disposing for exposure to the environment only the uncoated surfaces and edges of said fabric whereby the contiguous surfaces of said air chambers are arranged with the fabric side of said coated fabric opposed to the adjacent fabric side of said adjacent chamber and the internal surfaces of said air chambers are comprised of the coated surfaces of said fabric, welding the contiguous chambers of said BC together at said gas communication passages with aligned annular disks comprised of said one side coated fabric, said disks being disposed in each of said chambers to surround and overlap said gas communication passages formed in said fabric layers which are aligned in said air chambers, said disks being arranged in coated-surface-opposed facing-relation in the respective chambers whereby when said disks are welded together the center portions of said disks are joined together through said gas communication passages forming an air passage in the centers thereof, and the peripheral edges of said disks are joined to the internal surfaces of the contiguous air chambers respectively thereby interlocking said air chambers at the centers of said disks, and welding the peripheral edges of said internal surfaces of said chambers together to form an air containing BC.

2. A method of buoyancy compensator (BC) construction employing the method of claim 1 wherein said contiguous air chambers are formed by the steps of cutting contiguous panels of material of said fabric with aligned apertures for gas communication passages, providing a set of upward facing electrodes for welding said panels together at said gas communication passages, placing successively on said electrodes a first disk of said fabric with its coated side facing up, a first panel of said fabric with its coated side facing down and aligned concentrically on said disk, a second panel of said fabric with its coated side facing up and aligned concentrically with said first panel, and a second disk of said fabric with its coated side facing down and aligned concentrically with said second panel whereby a gas communication passage is created through all four layers of said material with the center portions of said disks in opposing coated surface contiguous relation and the outer coated portions of said disks disposed in contiguous relation to the coated surfaces of said first and second panels whereby said panels are disposed fabric to fabric surrounding said gas passages, placing a mirror image set of electrodes onto said upward facing electrodes on top of said second disk, welding the outer portion of said disks to said contiguous portions of said first and second panels of material respectively and said center portions of said disks together at the centers thereof, cutting a pair of external panels having the same peripheral configuration as said contiguous panels of material, and welding said external panels at the peripheral edges thereof to opposite sides of said contiguous panels respectively.

3. A buoyancy compensator (BC) construction having a single layer of uncoated external surface fabric for its air chambers comprising at least a pair of contiguous air chambers with a multiplicity of internal gas communication passages therebetween, said BC construction characterized by said air chambers being formed of a fabric having only the internal air chamber side thereof impregnated with a coating which is susceptible to welding to another surface of said coating, said air chambers having adjacent walls interlocked around said gas communication passages at a sufficient number of locations whereby said air chambers are tied together to form a bellows-type expandable bladder, the air chamber outer wall surfaces being welded to said expandable bladder at the peripheral edges thereof whereby all of the coated sides of said fabric comprising said BC are disposed internal to said air chambers and only the fabric sides are disposed outward and exposed to the external environment, and said air chamber walls being interlocked around said gas communication passages by a construction including for each interlock a pair of annular disks made of said coated fabric forming said bladder, said disks being disposed once each in each of said chambers for each of said passages with their coated surfaces in opposed welded relation on opposite sides of and surrounding said gas communication passages, said passages in said air chamber fabric being large enough in size to permit the center portions of said annular disks surrounding the center holes therein to be welded together therethrough with the outer peripheral portions of said disks surrounding said gas passages to be welded to the respective internal surfaces of the adjacent two contiguous fabrics which form said gas passages thereby interlocking said two fabrics in contiguous opposed relation.

* * * * *